US005363560A

United States Patent [19]

Makow

[11] Patent Number: 5,363,560

[45] Date of Patent: Nov. 15, 1994

[54] DEVICE FOR MAINTAINING PROPER SPACING AND LEVELLING OF TILES DURING LAYING THEREOF

[76] Inventor: Stan P. Makow, 228 Withrow Ave., Toronto, Ontario M4K 1E1, Canada

[21] Appl. No.: 25,129

[22] Filed: Mar. 2, 1993

[51] Int. Cl.[5] ..... E04G 21/16

[52] U.S. Cl. ..... 33/527; 33/DIG. 20; 52/392; 52/DIG. 1

[58] Field of Search ..... 33/527, 518, 526, 533, 33/DIG. 20; 52/561, 747, 127.3, 386, 387, 389, 392, DIG. 1

[56] References Cited

U.S. PATENT DOCUMENTS

| | | | |
|---|---|---|---|
| 2,852,932 | 9/1958 | Cable | 33/526 |
| 3,234,692 | 2/1966 | Bierlich | 52/392 |
| 3,501,877 | 3/1970 | White | 52/127.3 |
| 4,091,587 | 5/1978 | Depka | 52/561 |
| 4,953,341 | 9/1990 | Joos | 33/DIG. 20 |
| 5,259,161 | 11/1993 | Carter | 52/127.3 |

FOREIGN PATENT DOCUMENTS

| | | | |
|---|---|---|---|
| 2415702 | 9/1979 | France | 52/127.3 |

*Primary Examiner*—Christopher W. Fulton

[57] ABSTRACT

In the thin set laying of stone or ceramic tile, tiles are set by floating them over a uniformly applied screed of adhesive applied to a level substrate. In this invention combination spacing/levelling devices are used to equally space the corners of adjacent tiles and to maintain them at an equal elevation over the adhesive and substrate. The spacer/leveller device may comprise spacing fins and a guide for maintaining the corner of adjacent tiles flush while mortar is setting. The device works as a guide to facilitate level installation with uniform grout joints and it becomes part of the permanent fabric of the installation. Tiles are temporally supported by spacer/levellers at each corner (while adhesive is drying) and by virtue of the spacer/leveller design they are automatically flush to each other with equal joint spaces separating them. The invention substantially reduces the dependence on the skill of the tile layer to space tiles equally and set them on the same horizontal plane.

6 Claims, 4 Drawing Sheets

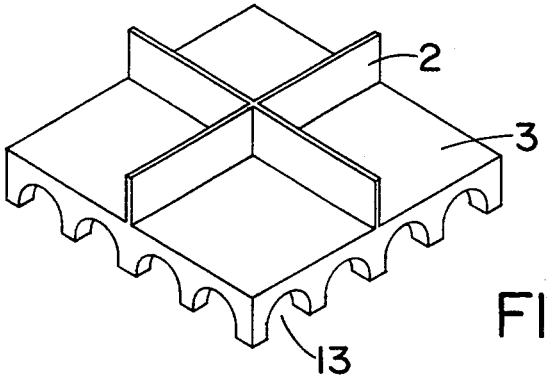
FIG. 10
FIG. 11
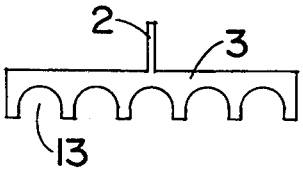
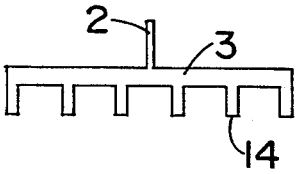
FIG. 12
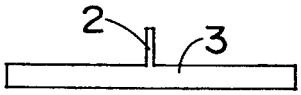
FIG. 13
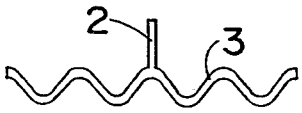
FIG. 14
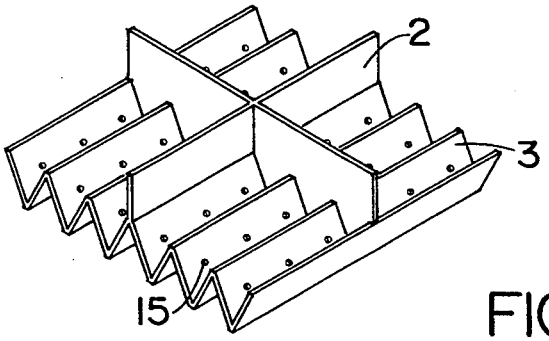
FIG. 15

DEVICE FOR MAINTAINING PROPER SPACING AND LEVELLING OF TILES DURING LAYING THEREOF

BACKGROUND OF THE INVENTION

1. Field of the Invention

This invention relates to a device for maintaining proper spacing and levelling of tiles during the thin setting of tiles. The tile may be stone, ceramic or porcelain and they are applied using a thin set adhesive compound on a level substrate.

2. Description of the Prior Art

In a conventional thin set system of laying floor tiles, a level, flat substrate is prepared of either plywood or concrete. In the case of a large floor, concrete is often used to level out any highs and lows in the structure. The concrete is allowed to dry thoroughly before setting tile. In smaller floors ½" plywood screwed to the structure is often used with shims to correct for non-levelness in the structure. Adhesive is then applied to the substrate in uniform thickness with a grooved trowel or spreader typically ⅛" to ¼" thick. Tiles are placed at the same height, level and flush with adjacent tiles. If a tile sits low, the tile layer lifts the tile and butters the bottom of the tile with additional adhesive. The tile is then placed down again and checked for height. If it is still low the latter step is repeated. If the tile sits high in relation to the adjacent tiles the tile layer will attempt to hammer it down with a rubber mallet. If this does not work satisfactorily the tile layer will lift up the tile and remove excess adhesive. Care must be also taken to ensure the joints between tiles are of uniform thickness. With marble or granite tiles it is desirable that the joints are tight usually approximately 1 mm wide. With other kinds of tiles joints vary from 2 mm to 10 mm depending on the desired appearance. Typically joints for ceramic or porcelain tiles are 3 to 4 mm in width. The tile layer, after establishing the desired joint thickness must ensure that all joints are of equal thickness. Thus the final success and beauty of the completed installation is dependent on the skill of the tile layer to set the tiles level and flush with even joints.

The problem with the conventional thin set installation method is it is difficult to achieve flush placement of tiles with equal joint thicknesses. Also, tiles may accidentally get depressed while the adhesive is setting. Accurate levelling tools and much time and care is needed to produce satisfactory work. The conventional method is labour intensive and thus expensive and the final result is not guaranteed but dependent on the skill of the individual tile layer. Workmanship, even by skilled tradesmen, often falls short of customer satisfaction.

There is a presently a device commercially available which is used as a spacer for the separation of tiles only. The device contains no levelling component and therefore the tile layer must still use levelling tools and check and adjust adhesive thicknesses as he works. In another device commercially available for the installation of large concrete roof pavers, a pedestal type device provides the structural support and alignment for the pavers over a roof deck. The pedestal type devices work as sleepers to permit water drainage between the pavers and roof deck and is not applicable to the laying of floor and wall tile using a cement type adhesive. No prior art which is more similar to my invention than that described is known to the applicant.

SUMMARY OF THE INVENTION

This invention comprises a device that comprises spacing fins for properly spacing the corners of adjacent tiles which is attached to, or forms an integral part of a levelling plate to set the comers of the adjacent tiles level. The levelling plate may be corrugated or of other suitable form to allow easy location of the device in supporting screed on which the tiles are to be laid. The device may be made out of hard plastic or other suitable materials such as metal, fibreglass, rubber, cardboard, cement, plaster or wood products.

I have found that the present invention can be used in the installation process of tile to insure level and flush placement of tiles with equal joints requiring less skill, care and time by the tradesman than in an installation not using this invention. The invention mitigates many of the problems in thin set tile laying discussed earlier. Similar to normal tile installation , a level and flat plywood or concrete substrate must first be prepared. Adhesive is then applied to the substrate with the spreader. The present invention (referred to herein as spacer/-leveller) is placed on the bed of adhesive at the locations of the four comers of the tile to be set. The spacer/-leveller is then pushed down hard to the substrate, squeezing out the adhesive so that the underside of the corrugations roughly touch the substrate. As the tiles are placed down, the spacer/levellers are slid over so that the corner of each tile rests snugly on each spacer/-leveller. This process is repeated as successive spacer/-levellers and tiles are laid down. Levelling tools are not required while laying the tiles. Where the tile pattern consists of a grid of rectangular tiles, each spacer/-leveller will support four tile comers except at the edge of the floor where the spacer/leveller will support only two tiles. Grouting of tiles follows according to the conventional procedure presently in use.

BRIEF DESCRIPTION OF THE DRAWINGS

The drawings which illustrate the principles of the embodiments of the invention may be modified and changed with respect to the immediate illustration all within the true scope and intent of the invention herein defined and claimed. In the drawings:

FIG. 10 is an axonometric view of a variation of the embodiment shown in FIG. 1 using a levelling plate incorporating bidirectional fluting;

FIG. 11 is a section view of a variation of the embodiment shown in FIG. 1 using a levelling plate with unidirectional fluting in the underside of the levelling plate.

FIG. 12 is a section view of a variation of the embodiment shown in FIG. 1 using a levelling plate comprising a flat slab with a series of parallel ridges extending from its underside.

FIG. 13 is a section view of a variation of the embodiment shown in FIG. 1 using a levelling plate that is a flat slab of uniform thickness, FIG. 14 is a section view of a variation of the embodiment shown in FIG. 1 using a levelling plate that is corrugated in shapes; and FIG. 15 is an isometric view of another variation of the embodiment shown in FIG. 1 with perforations on the levelling plate.

DETAILED DESCRIPTION OF PREFERRED EMBODIMENTS

Figure 1:
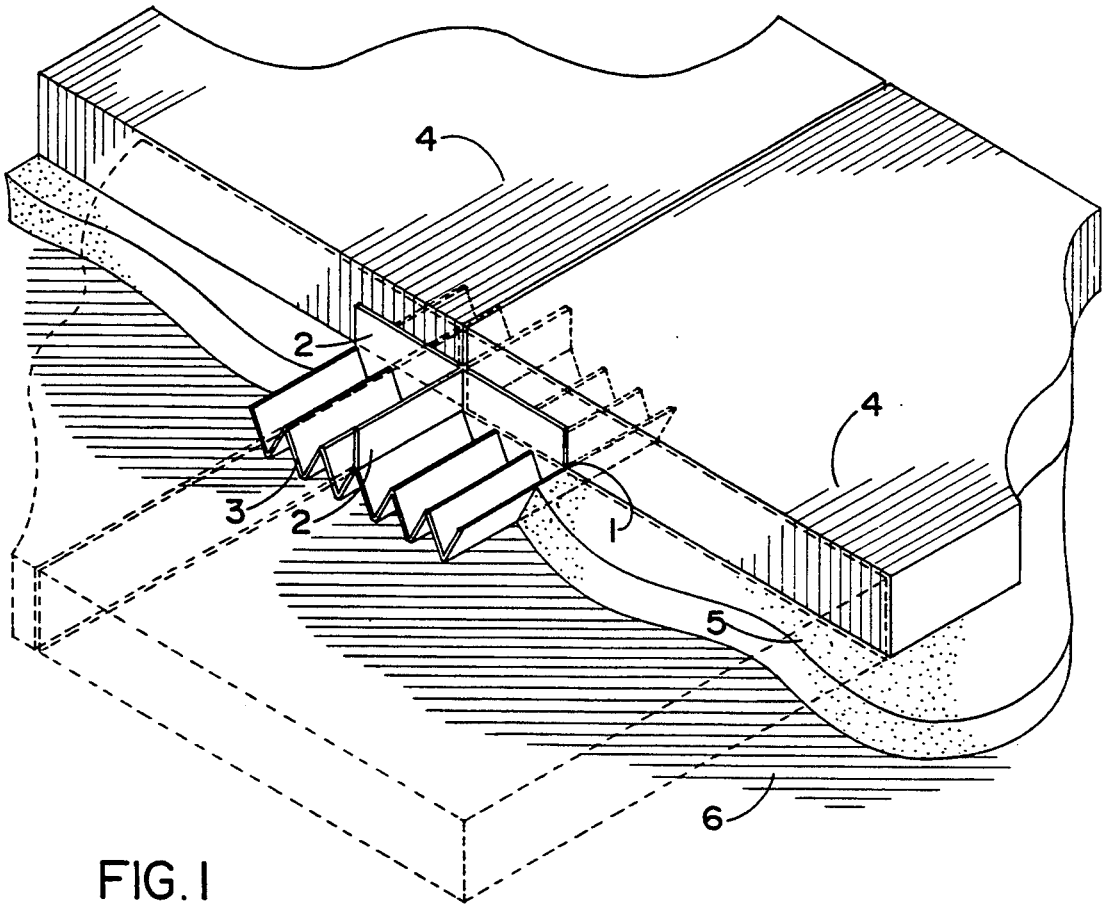
FIG. 1 is an isometric view of the tile spacer/leveller set on substrate with tiles interposed at two locations.
Figure 2:
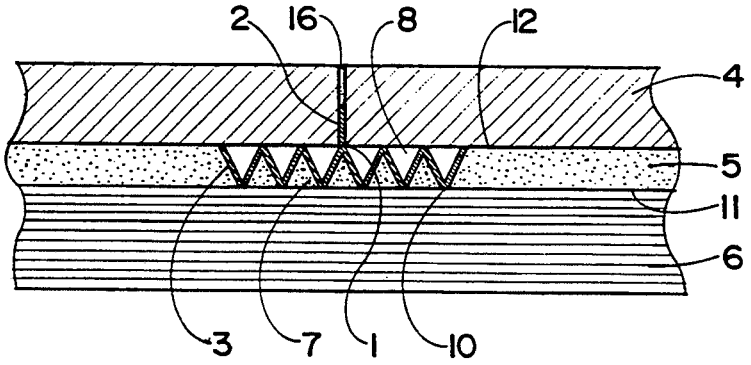
FIG. 2 is the section view of the embodiment shown in FIG. 1.

The present invention will be described herein after with reference to FIGS. 1–12 in which like reference numerals designate like or corresponding parts throughout. FIGS. 1 & 2 illustrate an embodiment of the present invention sitting on the substrate 6. The spacer/leveller device 1 comprises spacing fins 2 attached to levelling plate 3. Levelling plate 3 is comprised of V-shape corrugations which allow adhesive to be squeezed out at either end when the spacer/leveller is set down on the substrate 6 coated with the adhesive screed 5. The levelling plate 3 is of constant height so that the surface 11 of the substrate and the underside 12 of the tile will be parallel. Spacing fins 2 as shown in FIG. 1 is used for spacing four abutting tiles of a rectilinear grid format. The thickness of all the spacing fins is identical. Tiles 4 rest on levelling plate 3 and are separated by spacing fins 2. Adhesive screed 5 sits on substrate 6 below the tiles 4. Adhesive 7 will sit beneath spacer/leveller 1 with excess adhesive being squeezed out via the V shape corrugations. No adhesive is located above the levelling plate 3 in cavity 8 of the corrugations. Any trapped adhesive under the tile can flow into these cavities 8 and thus not encumber positive contact between the tile 4 and the line of contact on the spacer/leveller 12, Grout 16 fills the joint between the tiles 4 covering spacing fins 2.

Figure 3:
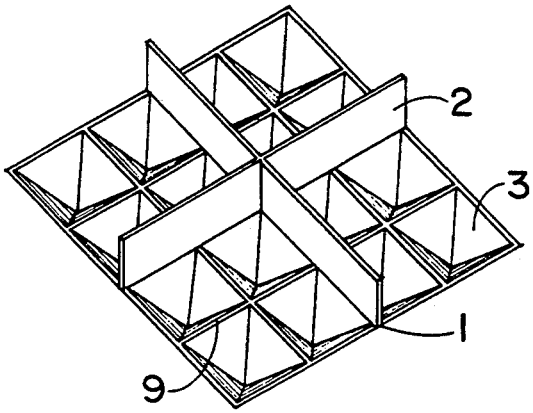
FIG. 3 is an isometric view of the preferred embodiment illustrating the form of the spacer/leveller when viewed from above.
Figure 4:
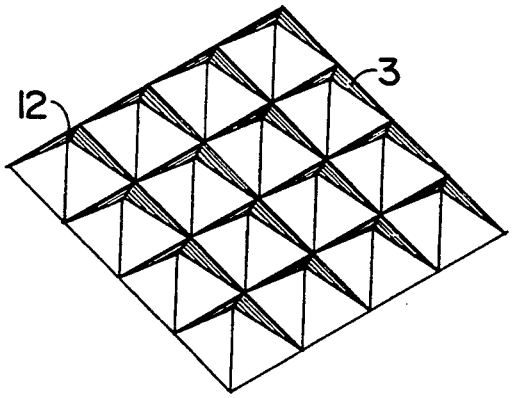
FIG. 4 is an isometric view of the spacer leveller when viewed from below.
Figure 4A:
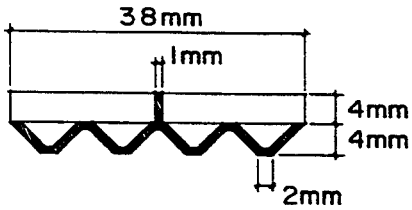
Figure 5:
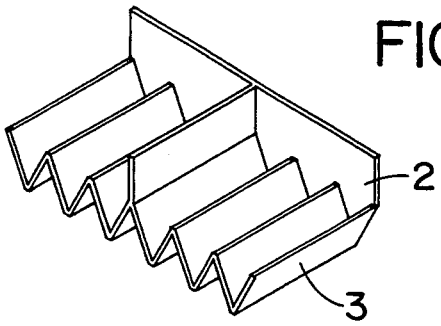
FIG. 5 is an isometric view of another embodiment used for edges of tiled areas.

FIGS. 3 and 4 illustrate another embodiment of the present invention. This embodiment comprises spacing fins 2 as described previously attached to a levelling plate 3 which consists of a four by four array of inverted hollow pyramids. Each pyramid is identical in height and width. The levelling plate 3 sits on the substrate making contact at sixteen points 12 at the apex of the pyramids. This design involves a minimum displacement of adhesive 7 from under the levelling plate. The pyramid form provides maximum strength for material used. While a four by four array is described and illustrated it will be appreciated that different arrays are possible. FIG. 5 shows a variation of the embodiment shown in FIG. 1 used at edges of tile patterns. The spacing fins 2 are T shaped when viewed from above. The top of the T aligns with edge of the levelling plate. The levelling plate 3 is half the size of that shown in the embodiment illustrated in FIG. 1 because of its use at edge of tile patterns.

Figure 6:
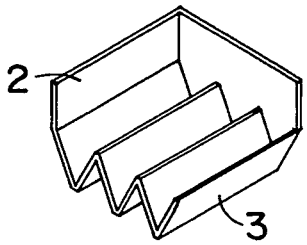
FIG. 6 is an isometric view of another embodiment used for comers of tiled areas.

FIG. 6 shows a variation of the embodiment shown in FIG. 1 used for comers of tile patterns. The spacing fins 2 are L shaped when viewed from above and we connected to the levelling plate 3 at the edges.

Figure 7:
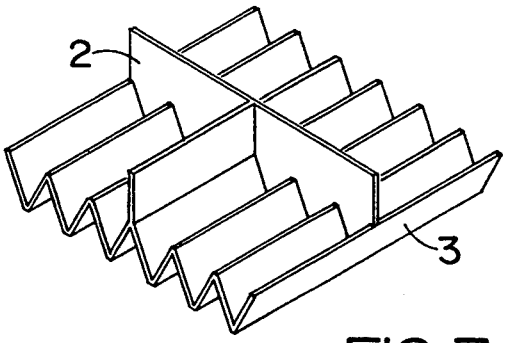
FIG. 7 is an isometric view of another embodiment used for rectangular tiles in a staggered pattern.

FIG. 7 shows a variation of the embodiment shown in FIG. 1 used for staggered tile patterns. A T shape spacing fin 2 is connected to the levelling plate 3 in a the center.

Figure 8:
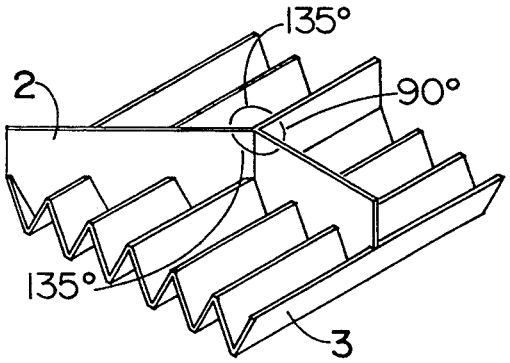
FIG. 8 is an isometric view of another embodiment used for tile patterns composed of octagonal and square tiles.

FIG. 8 illustrates a variation of the spacer/leveller used for tile patterns composed of octagonal and square tiles. The spacing fins 3 are Y in shape when viewed from above with the fins being offset from each other at 90 degrees, 135 degrees and 90 degrees respectively.

Figure 9:
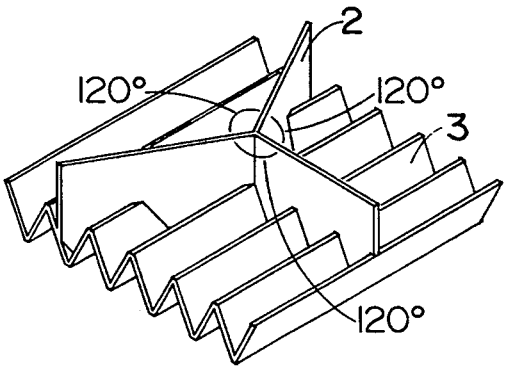
FIG. 9 is an isometric view of another embodiment used for tile patterns composed of hexagonal tiles.

FIG. 9 illustrates a variation of the spacer/leveller used for tile patterns composed of hexagonal tile. The spacing fins 3 are Y in shape when viewed from above with the fins each being offset from the other by 120 degrees.

FIG. 10 illustrates another embodiment of the spacer/leveller in which the levelling plate is made of a flat plate with semi-circular channels 13 routed out of, or formed on the bottom equally spaced in two directions.

FIG. 11 illustrates another embodiment of the spacer/leveller in which the levelling plate is made of a flat slab with parallel fluting 13 formed on the underside of it.

FIG. 12 illustrates another variation of the embodiment of the spacer/leveller where the levelling plate 3 comprises a fiat plate with a series of parallel ridges 14 of uniform height extending down from its underside.

FIG. 13 illustrates another variation of the embodiment of the spacer/leveller where the levelling plate comprise a simple fiat slab 3 of uniform thickness.

FIG. 14 shows yet another variation of the embodiment of the spacer/leveller where the levelling plate 3 is a corrugated form of constant height.

FIG. 15 illustrates a further embodiment of the device where the levelling plates described above contains holes 15 or perforations which would improve ease of placement where adhesives are of high viscosity.

Any one of the embodiments for the spacing fins form described in the foregoing can be used in combination with any one of the embodiments of the forms of the levelling plates described in the foregoing.

All the embodiments described above could be made of hard plastic in a process of plastic injection into a mould of the entire embodiment. Alternatively the embodiments could be cast from metal, cement, plaster or fibre glass and resin mix. Alternatively the embodiments could be of wood or composite pulp/wood products and made by an embossing press.

While the preferred embodiments of the invention have been explained and illustrated it will be appreciated that the invention is not restricted to these specific forms but it may consist of further embodiments and is of broader scope as defined in the claims.

I claim:

1. A tile leveller and spacing device for use in the laying of individual tiles in adjacent relationship with one another, the device comprising:

i) a corrugated levelling plate of uniform plate thickness to space corners of adjacent tiles to be level above a level surface on which tiles are to be laid; and ii) a plurality of spacing fins angled one to another and extending perpendicularly upwardly from said levelling plate, each of said fins having a fin thickness to space edges of said adjacent tiles apart by a distance equal to said fin thickness, and the angles between the fins being selected for lodgement of tile corners therein.

2. The device according to claim 1 in which the said corrugated levelling plate has V-shaped corrugations.

3. The device according to claim 1 where in the said corrugated levelling plate comprises an array of hollow inverted pyramid corrugations.

4. A device according to claim 1 wherein said corrugated levelling plate has fluting corrugations in its undersurface.

5. A device according to claim 4 wherein the said fluting is bidirectional.

6. A device according to claim 1 wherein the said corrugated levelling plate is form as a uniform thickness slab with a series of vertical parallel ridge corrugations of constant height projecting from its undersurface.

* * * * *